United States Patent [19]

Cameron

[11] Patent Number: 5,044,431

[45] Date of Patent: Sep. 3, 1991

[54] TUBE LAYOUT FOR HEAT EXCHANGER

[76] Inventor: Gordon M. Cameron, 4 Wellesbourne Cres., Willowdale, Ontario, Canada, M2H 1Y7

[21] Appl. No.: 570,564

[22] Filed: Aug. 21, 1990

[30] Foreign Application Priority Data

Aug. 24, 1989 [CA] Canada ..... 609339

[51] Int. Cl.[5] ..... F28D 7/10

[52] U.S. Cl. ..... 165/158; 165/159

[58] Field of Search ..... 165/158–162

[56] References Cited

U.S. PATENT DOCUMENTS 3,587,732 6/1971 Burne ..... 165/158
4,357,991 11/1982 Cameron ..... 165/159

FOREIGN PATENT DOCUMENTS 190960 7/1957 Austria ..... 165/158
875578 9/1942 France ..... 165/158
997627 1/1952 France ..... 165/158
60-186691 9/1985 Japan ..... 165/158
1010494 11/1965 United Kingdom ..... 165/158

*Primary Examiner*—Allen J. Flanigan
*Attorney, Agent, or Firm*—Rogers, Bereskin & Parr

[57] ABSTRACT

A heat exchanger having two or more tube bundles extending parallel to the shell with a central longitudinal space between the tube bundles. The tube bundles have a longitudinal axis is symmetry in such space. The tubes in each bundle are laid out in concentric arcs. The arcs of each bundle have a common center of curvature which is displaced from the axis of symmetry and also from the center of curvature of each other tube bundle. The corners between the tube bundles may contain fill-in tubes. This allows compact tube packing while preserving relatively uniform fluid velocities.

8 Claims, 7 Drawing Sheets

TUBE LAYOUT FOR HEAT EXCHANGER

FIELD OF THE INVENTION

This invention relates to a heat exchanger having an improved tube layout.

BACKGROUND OF THE INVENTION

The way in which tubes are laid out in a heat exchanger design is critically important if proper shell-side heat transfer is to be obtained. Research in this area of heat transfer has been conducted by many investigators over the last century. The problem of containment of the shell-side fluid, which is normally under pressure, has been most effectively resolved by the use of cylindrical shells, and the studies commonly involve internal flow-directing baffles as well as tubing layout to generate optimum heat transfer for given pressure losses.

Typical heat exchangers use tubes arrayed in a variety of tube pitches, equilateral triangles, isosceles triangles, square and rotated square pitches, and more recently a radially symmetrical pitch in which tubes are arrayed in concentric rings with an open core and an open outer annulus. These arrangements can be seen in Perry, J. H., "Chemical Engineers Handbook" and in U.S. Pat. No. 4,357,991 issued Nov. 9, 1982 naming Gordon M. Cameron as inventor (the "Cameron" patent).

To control shell-side flow, baffles are normally used in the shell and tube heat exchanger and force the fluid to cross and re-cross the heat exchanger tube bundle, generating turbulence and heat transfer in the process. The more conventional baffling arrangements include single and double segmental baffles which force the fluid to travel across the bundle in one access.

The Cameron patent describes a method of tubing layout involving concentric rings laid out so that the diagonal ligaments between tubes in adjacent rings offer the minimum cross-section for flow. This approach is very useful for tube bundles of limited transverse thickness but problems occur when a thicker tube bundle is required. Specifically, the problem occurs when the outer rings become sufficiently close to each other that the radial distances between the tubes reach a minimum and force an increase in the diagonal ligaments. Although the approach in the Cameron patent allows a second family of rings to be placed outside the main series with smaller ligaments and more tubes per ring, the discontinuity caused by the change in the ring tubing density significantly moves the outer edge of the bundle outwardly and makes the heat exhanger dimension larger. In addition there is a discontinuity in flow between the families of rings.

It is therefore an object of the invention to provide a heat exchanger having an improved tubing layout which allows compact tube packing while being capable of preserving relatively uniform fluid velocities as the fluid moves radially inwardly and outwardly through the tubes.

The invention also permits a tubing bundle to be designed which can approach closely to a square or polygonal cross-section, allowing compact large capacity units to be fabricated and shipped.

In its broadest aspect the invention provides a heat exchanger for exchanging heat between fluids and having a shell and at least first and second tube bundles extending longitudinally in said shell, each tube bundle comprising a plurality of longitudinally extending parallel tubes laid out in a set of concentric circular arcs, said tube bundles defining a central space between them, said central space also extending longitudinally in said shell and being parallel to tubes, said tube bundles having together a longitudinal axis of symmetry between them extending through said central space, the arcs of said first tube bundle having a first common center of curvature and the arcs of said second tube bundle having a second common center of curvature, said first and second centers of curvature being displaced from said axis of symmetry and from each other.

Further objects and advantages of the invention will appear from the following description, taken together with the accompanying drawings.

DETAILED DESCRIPTION OF PREFERRED EMBODIMENTS

Figure 1:
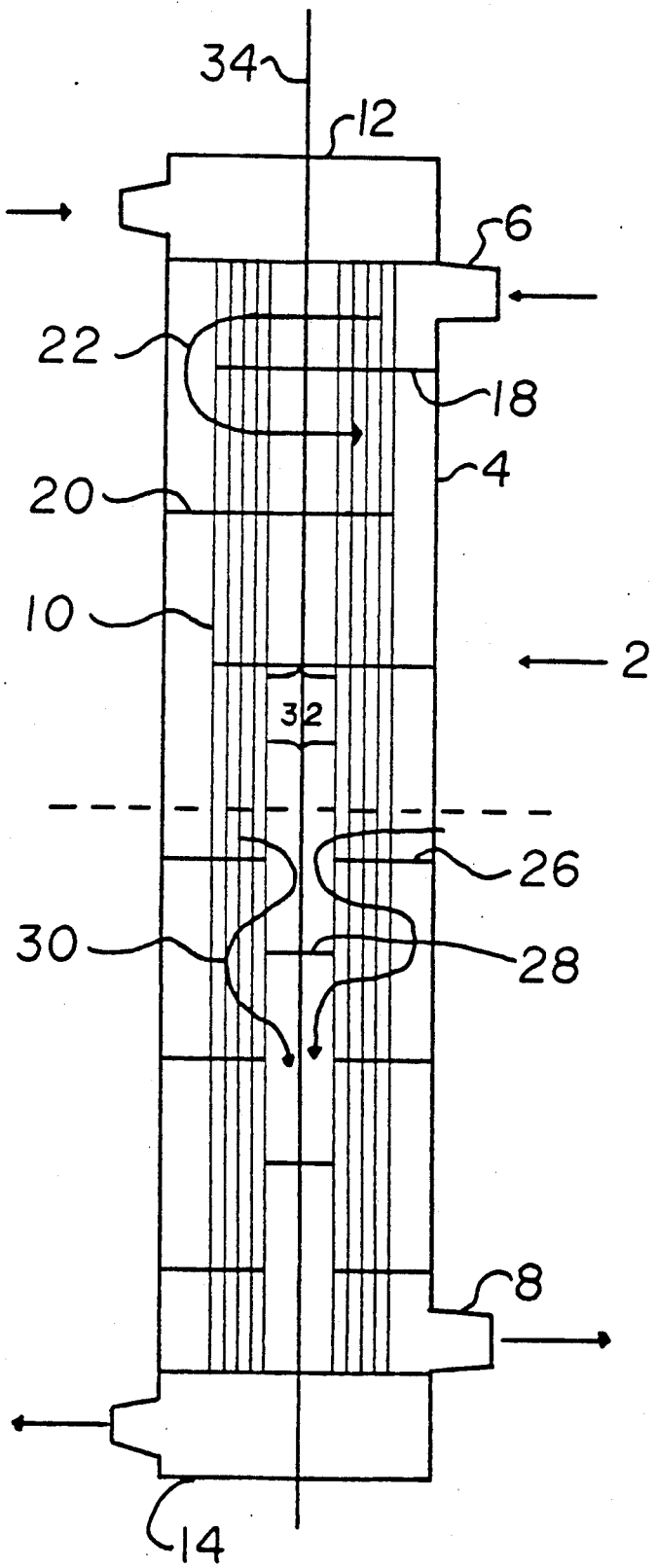
FIG. 1 (PRIOR ART)
FIG. 1 is a diagrammatic view of a typical prior art heat exchanger, showing both single segmental and double segmental baffles.

Reference is first made to FIG. 1, where there is diagrammatically shown a cylindrical heat exchanger 2. The heat exchanger 2 has a cylindrical shell 4 having an inlet opening 6 and an outlet opening 8 for fluid which is to be heated or cooled. Such fluid, since it is contained by the shell, is referred to as "shell-side" fluid.

The heat exchanger 2 also has a number of parallel tubes 10 which extend longitudinally in the shell 4 between an inlet vestibule 12 and an outlet vestibule 14. Heat exchange fluid for the tubes (used for heating or cooling the shell-side fluid) enters at one of the vestibules and leaves at the other.

The upper portion 16 of the shell is shown as having single segmental baffles 18, 20, each of which extends laterally partway across the shell to force the fluid to flow across the tubes 10 as indicated by arrow 22. The bottom half 24 of the heat exchanger is shown as having double segmental baffles 26, 28, having a kind of disc and donut configuration, which also force the fluid to travel across the tubes 10 as indicated by arrows 30. In practice a heat exchanger will normally have only one kind of baffle arrangement, either single or double segmental.

In all cases, the tubes are laid out to provide a longitudinal central open space 32 between the tubes and extending the length of the heat exchanger. At the center of the open space 32 is the center point or longitudinal axis of symmetry 34 of the tubes 10 (and also, normally, of shell 4).

Figure 2:
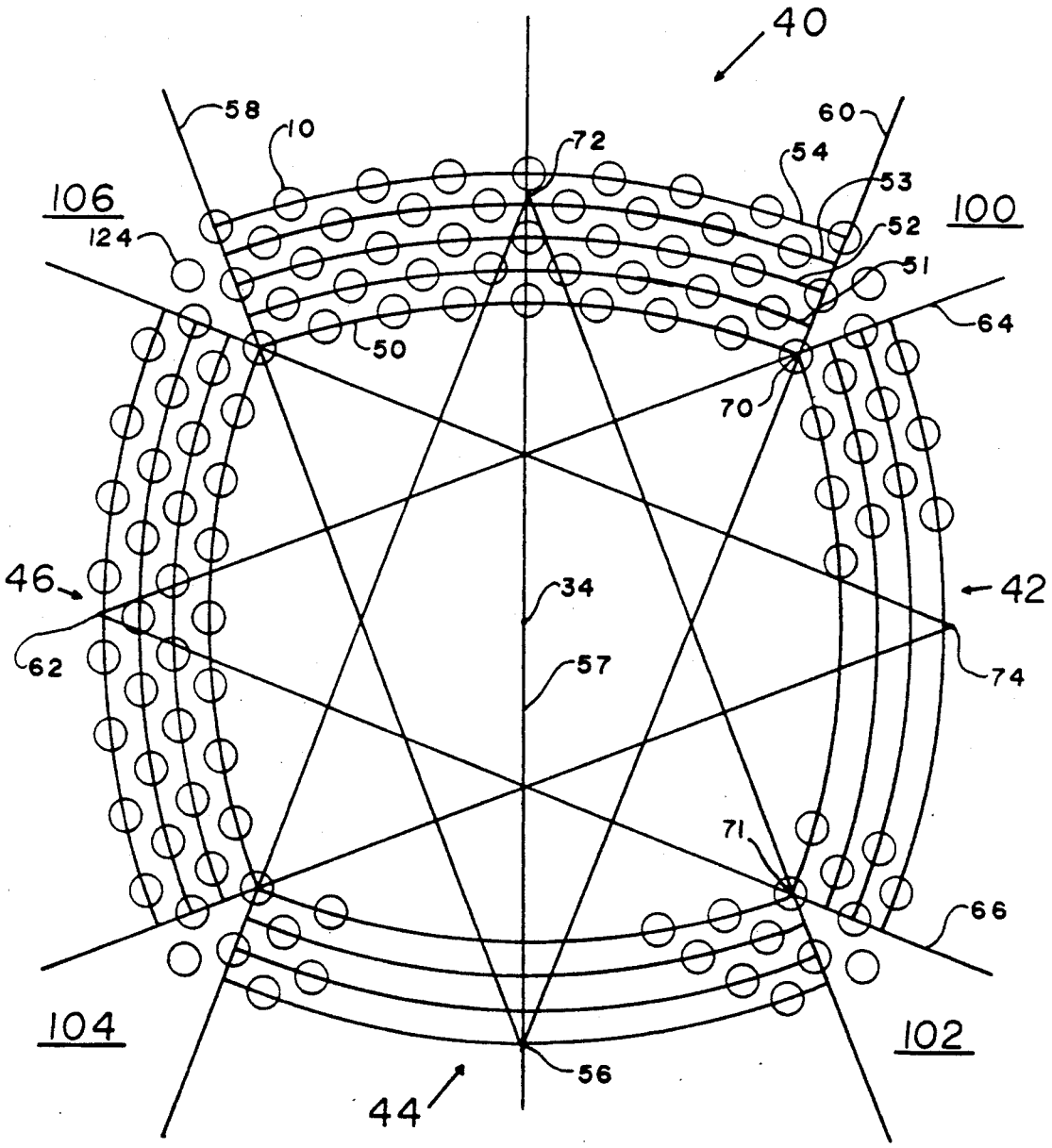
FIG. 2 is a diagrammatic cross-sectional view showing a heat exchanger tubing layout according to the invention.

Reference is next made to FIG. 2, which shows a tube layout according to the invention. As shown in FIG. 2 there are four tubing bundles, indicated at 40, 42, 44 and 46. These tubing bundles are all the same and therefore only tubing bundle 40 will be described.

Tubing bundle 40 consists of tubes 10 laid out on a number of concentric arcs, indicated at 50, 51, 52, 53, 54, etc. These arcs all have a common center of curvature, but their center is not the center point or axis of symmetry 34. Instead the center of curvature of arcs 50 to 54 is indicated at 56 and is displaced from center 34 along a line 57 which bisects the arcs 50 to 54 and passes through the center 34. The center 56 can be referred to as a "meta-center" since it does not coincide with center 34.

The ends of the arcs 50 to 54 are defined by radial lines 58, 60 drawn outwardly from meta-center 56. These lines define the circumferential limits of the tube bundle 40.

Similarly, the arcs defining tube bundle 42 have their center of curvature located at meta-center 62. Meta-center 62 is located on a line drawn through center 34 and bisecting the arcs of tube bundle 42. The ends of tube bundle 42 are defined by lines 64, 66 extending radially outwardly from meta-center 62. Lines 60 and 64 both pass through the intersection 70 of the innermost arcs of tube bundles 40 and 42. Radially directed line 64 passes through point 71 which is defined by the intersection of the innermost arcs of tube bundles 42 and 44.

The remaining tube bundles 44 and 46 have meta-centers 72 and 74 respectively and, as indicated, are the same as tube bundles 40, 42 and are laid out in the same way. Thus, each individual tube bundle has a meta-center which is displaced from the meta-center of each other tube bundle and also from the center 34. The meta-center for each tube bundle is normally on the opposite side of the center 34 from the tube bundle, e.g. the radius of curvature for tube bundle 40 is greater than the distance from innermost arc 50 to center 34. (However in some circumstances this need not be so, as described in connection with FIG. 5.)

Figure 3:
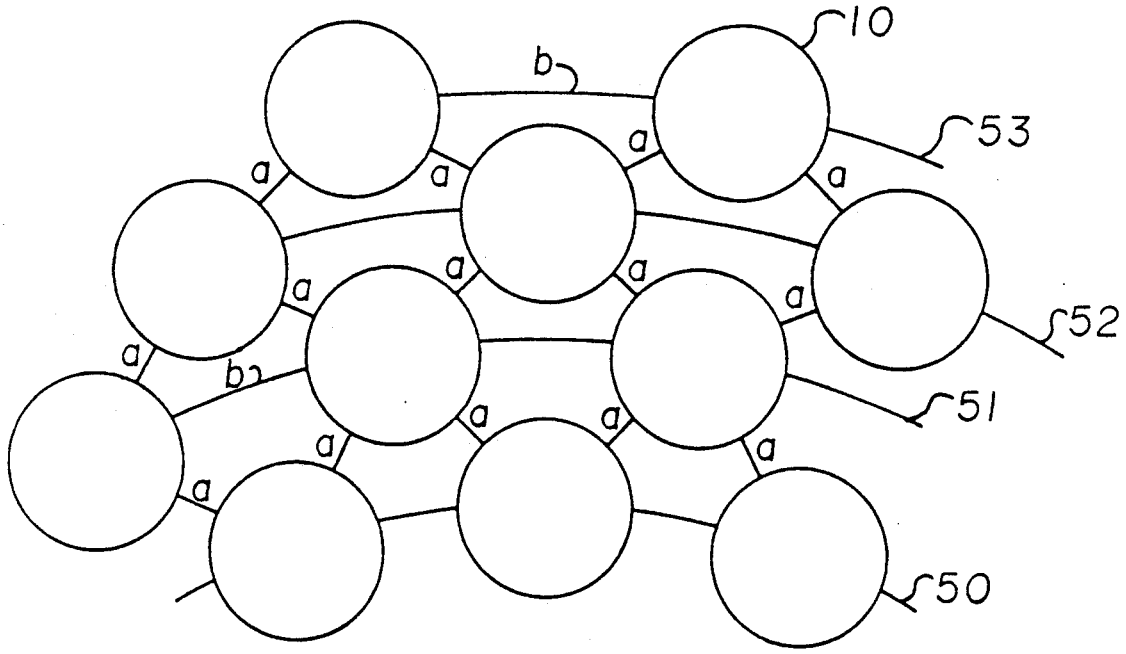
FIG. 3 shows one method of arranging the tubes for the layout of FIG. 2.

The tubes in each tube bundle can be laid out in any desired manner. One such arrangement can be that shown in the Cameron patent, as indicated in FIG. 3. In this arrangement tubes 10 are shown as being laid out along arcs 50 to 53. There are diagonal ligaments "a" between each tube in each arc or ring and the two closest tubes in each radially adjacent ring. The distance "b" between two adjacent tubes in any arc is at least twice as great as the diagonal ligament space "a". (Distance "b" is greater for outer arcs and therefore is not constant.) Thus, as described in the Cameron patent, the ligament gaps "a", which are always constant, always determine the minimum flow area between adjacent arcs and therefore the mass flow of velocity through each of the tube bundles is constant.

It will be noted that in the Cameron patent, as one proceeds outwardly in the tube bundle, the outer rings become more closely spaced radially and (as mentioned) the tubes in the outer rings move farther apart circumferentially, in order to maintain a constant diagonal ligament spacing "a" and to ensure that the circumferential spacing "b" is always greater than or equal to 2*a*. A limit is reached, as described in equation (7) in the Cameron patent, at which the outer rings become so closely spaced radially that no further outer rings can be added in that tube family, and a new tube family must be started. This results in the undersirable discontinuity mentioned earlier.

With the present invention, the effective radius e.g. of the arcs 50 to 54 in bundle 40 is larger than would be the case if the center of curvature of these arcs were at the center 34 of the shell. Therefore the outermost arc can have a larger radius (i.e. the tube bundle can be thicker) before the outer limit is reached which is described in equation (7) in the Cameron patent, i.e. where the radial distance between any two arcs becomes too small.

If it is desired to provide a thicker tube bundle than can be accommodated by the layout described in the Cameron patent, then the innermost ring can be designed so that in the two inner arcs, "b"$\approx$1.5a, rather than 2a. Then in the next rings typically "b"$\approx$1.9a. While this will create a slightly increased pressure drop in the inner rings, this will not have a major effect on the performance of the heat exchanger.

Figure 4:
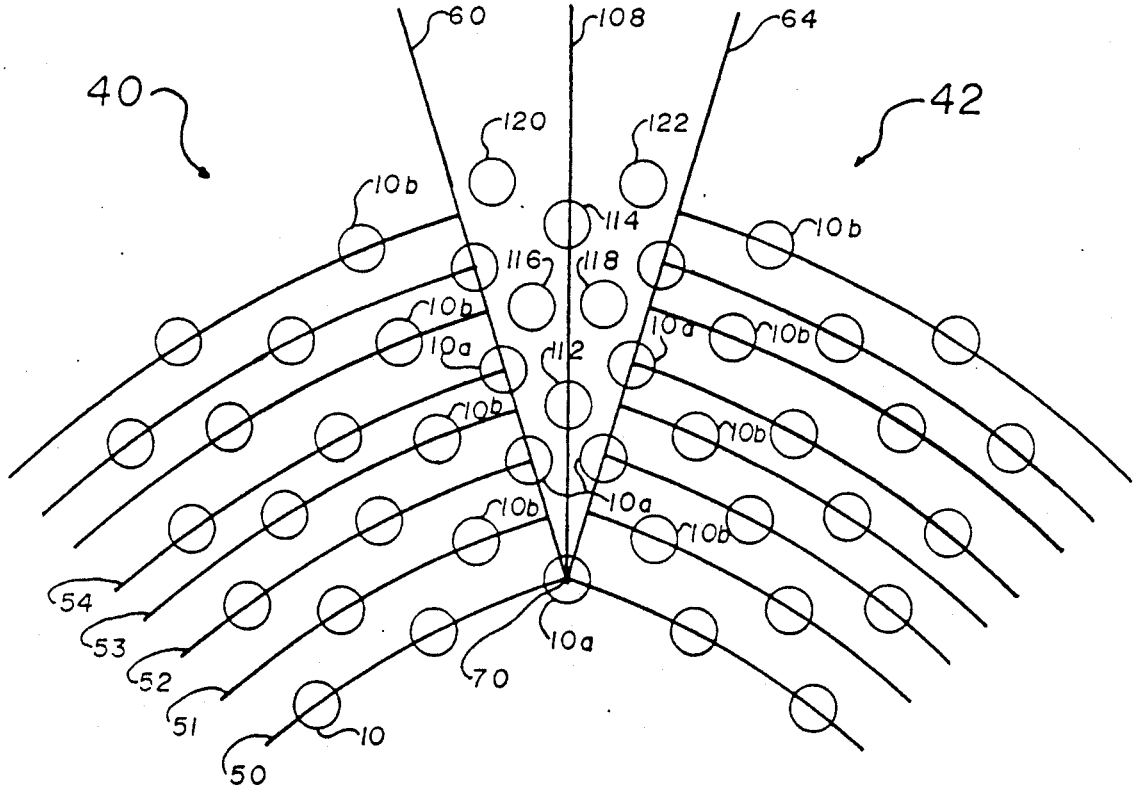
FIG. 4 shows an alternative corner layout for the arrangement of FIG. 2.

With the arrangement shown in FIG. 2, there are corner spaces, indicated at 100, 102, 104 and 106 which must be considered. The corner spaces are relatively small and can be dealt with in several ways. One way is simply to wall them off. Another approach, which is preferred, is to insert tubes in the corner spaces as indicated in FIGS. 2 and 4. In FIG. 4, tubes 10*a* are shown as located on the ends of the innermost arcs, e.g. arc 50, and on the ends of each alternate outwardly spaced arcs, e.g. arcs 52, 54. The end tubes 10*b* are spaced slightly inwardly from the end of intermediate arcs such as arcs 51, 53. In that case, a line 108 drawn from center 34 through corner 70 and bisecting the angle between lines 60, 64 may be drawn (line 108 will pass through center 34), and tubes may be placed on line 108 for arc 54 and for those other outer arcs not having tubes at their ends. The additional "fill-in" tubes are indicated at 112, 114 in FIG. 4. As the design proceeds radially outwardly, additional fill-in tubes may be added as indicated at 116, 118, 120, 122. While there will be a discontinuity at the corners, the discontinuity is small and has only a minor effect on the uniformity of heat transfer.

Alternatively, as shown in FIG. 2, the ends of the innermost arcs such as arc 50 can have no tubes located there. Instead each such end can be midway between the end tube of that arc and the end tube of the adjacent arc. In that case the same procedure can be used to lay out fill-in tubes, but such tubes will typically begin in an interior arc, such as the third arc (as shown at 124 in FIG. 2).

In designing a heat exchanger using the layout of FIG. 2, the designer will normally begin by evaluating the heat load and the temperature difference, estimating the heat transfer co-efficient, and the designer will thus determine the area for heat transfer. The tube size and number of tubes are then calculated and one-quarter of the necessary tubes are allocated to each bundle.

Next, a minimum diagonal or ligament distance "a" is selected and the approximate number of tubes per arc is selected. It is noted that dimension "a" is largely chosen by determining the velocity of the fluid in the heat exchanger. If the tube spacings are too small, the kinetic energy loss for heat transfer is too high and high pressure losses result. If the spacings are too large, then the heat exchanger itself becomes unnecessarily large and expensive.

Once a ligament distance "a" is selected, then the number of tubes per arc is determined. If each arc, e.g. arc 50, were a straight line, then the number of tubes per arc would be the length of such straight line divided by the sum of the tube diameter and dimension "a". According to the design procedure, the number of tubes per arc is increased to one more than would be necessary if the arcs were straight lines, and a tube layout is determined. The number of tubes per arc is then increased in steps of one (thus increasing the curvature of the arcs) until an outer limit is reached at which tubes become too close to each other radially. This calculation sets the limit for the number of tubes per arc. If the number of tubes yielded by this procedure is higher than needed, then fewer arcs can be used. Further optimization of the design to set the baffle spacing may result in a reduction or an increase in the number of tubes per arc to match the pressure losses in the exchanger with those allowed. The same procedure is of course used for bundles 42, 44, 46.

Figure 5:
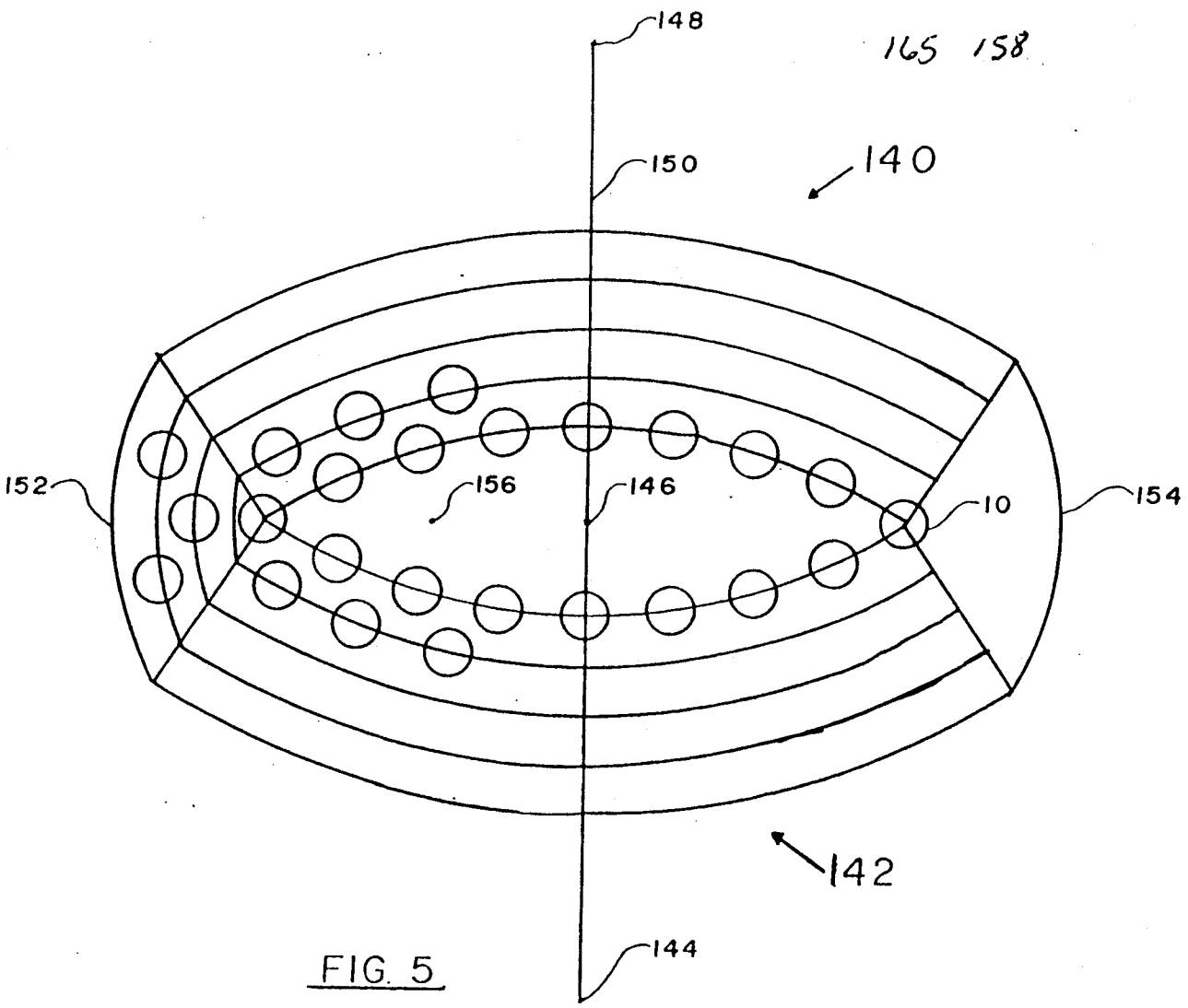
FIG. 5 shows a modification of the FIG. 2 arrangement, having two tube bundles.

Although FIG. 2 shows four tube bundles having four meta-centers, the number of tube bundles can be changed. For example as shown in FIG. 5 there can be only two tube bundles, marked as 140 and 142. The arcs of tube bundle 140 have a meta-center located at 144, displaced from the longitudinal center or axis of symmetry 146 of the heat exchanger. The arcs of tube bundle 142 have a meta-center 148 also displaced from center 146. In this case all three centers lie on a straight line 150 and the heat exchanger shell will normally be of non-circular shape (e.g. it can be generally elliptical). The ends of tube bundles 140, 142 are as before defined by radially directed lines drawn from their meta-centers.

In the FIG. 5 case the corners 152, 154 will normally be blocked off, although if desired they can be filled with still further tube bundles having different meta-centers. It is not necessary that the innermost arcs of each tube bundle all have the same radius of curvature, and in FIG. 5 one corner bundle 152 is shown having a meta-center at 156. In the FIG. 5 example the radius of the innermost arc of bundle 152 is less than the distance from such arc to the center 146. In this case the ends of tube bundle 152 are defined by the ends of tube bundles 140, 144 and not by radially directed lines drawn from its meta-center 156.

Figure 6:
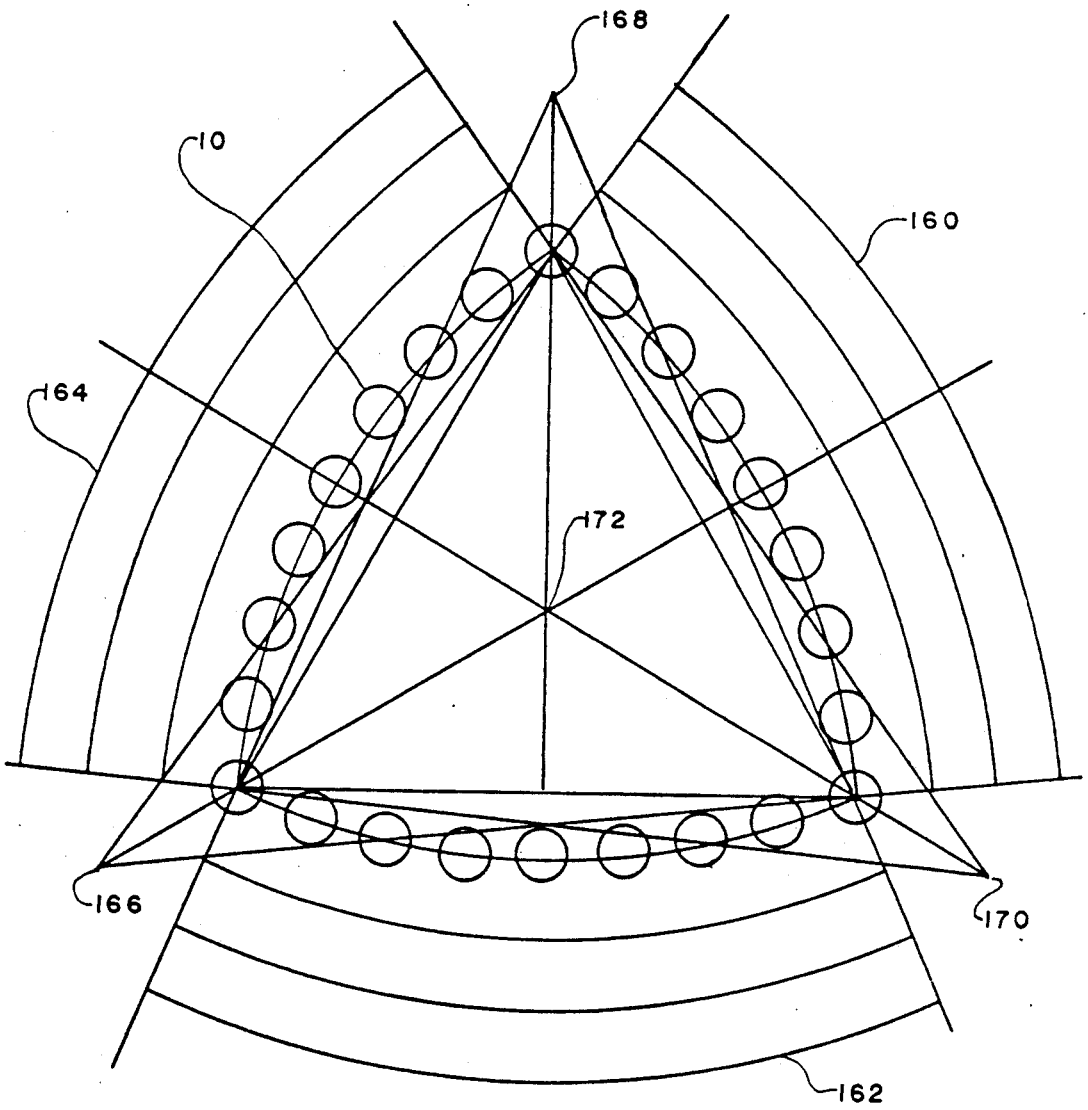
FIG. 6 shows a further modification of the FIG. 2 arrangement, namely three tube bundles arranged in a triangular configuration.

FIG. 6 shows a further arrangement having three tube bundles arranged in triangular form and shown at 160, 162, 164. Again, the meta-centers 166, 168, 170 respectively of the tube bundles 160, 162, 164 do not coincide with the center of symmetry 172 of the tube bundles or with each other.

Figure 7:
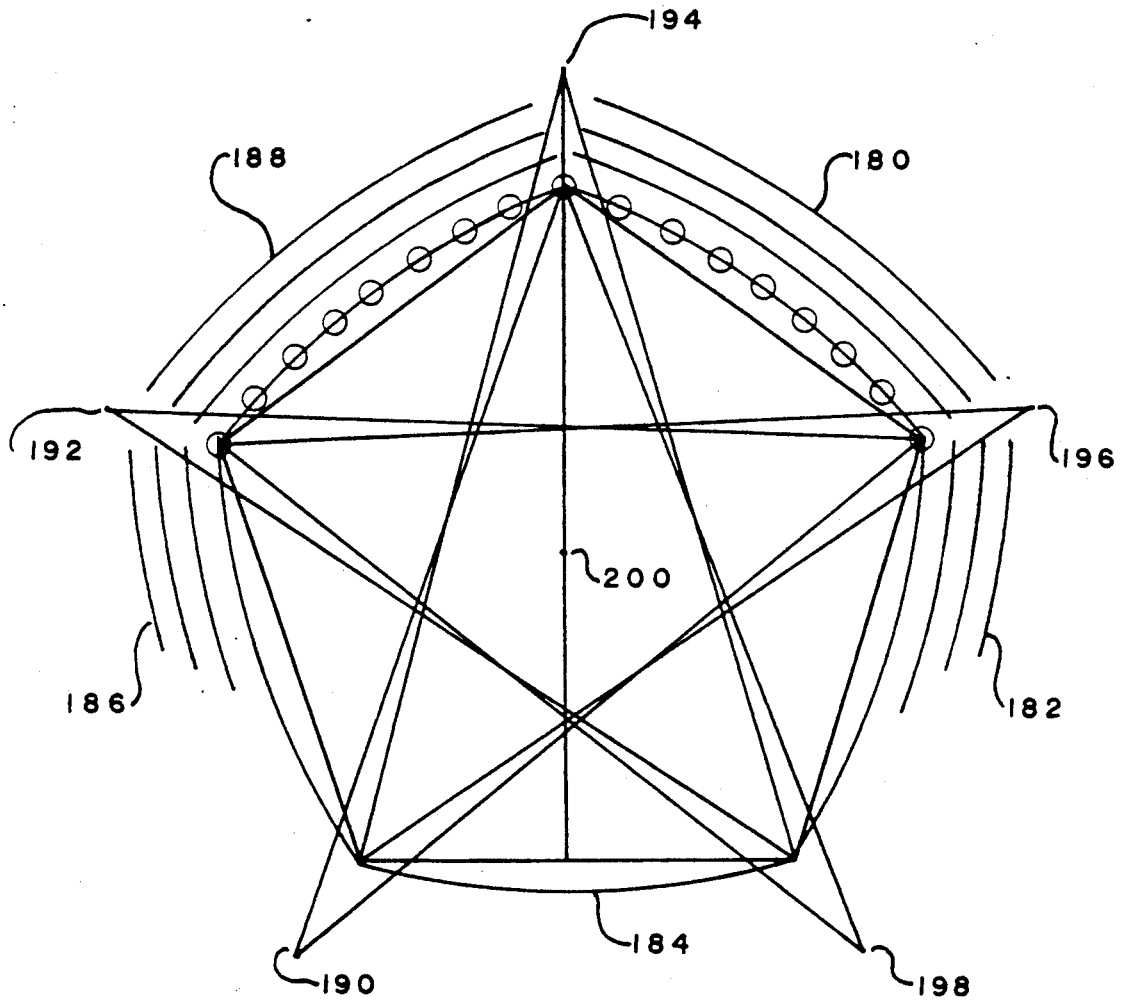
FIG. 7 shows a further modification of the FIG. 2 arrangement, namely five tube bundles arranged in a pentagonal configuration.

FIG. 7 shows a pentagonal arrangement having five tube bundles 180 to 188 inclusive. Again, each of these tube bundles has its meta-center 190 to 198 respectively displaced from the center of symmetry 200 of the tube bundles, and also from the meta-centers of the other tube bundles.

Although the tube layout shown in the Cameron patent is generally suitable for use with the invention, other well known tube layouts (as described earlier in this application) can also be used.

I claim:

1. A heat exchanger for exchanging heat between fluids and having a shell and at least first and second tube bundles extending longitudinally in said shell, each tube bundle consisting of a plurality of longitudinally extending parallel tubes laid out in a set of concentric circular arcs which extend less than 180 degrees, said tube bundles defining a central space between them, said central space also extending longitudinally in said shell and being parallel to tubes, said tube bundles having together a longitudinal axis of symmetry between them extending through said central space, the arcs of said first tube bundle having a first common center of curvature and the arcs of said second tube bundle having a second common center of curvature, said first and second centers f curvature being displaced from said axis of symmetry and from each other.

2. A heat exchanger according to claim 1 wherein the number of said tube bundles is 3, 4, or 5, the arcs of each individual tube bundle having a common center of curvature, said centers of curvature for each tube bundle being displaced from said axis of symmetry and from each other.

3. A heat exchanger according to claim 2 wherein there are four said tube bundles.

4. A heat exchanger according to claim 3 wherein said tube bundles define four corner spaces between them, and wherein there are additional tubes in said corner spaces.

5. A heat exchanger according to claim 4 wherein tubes are located on the ends of the innermost arcs of each tube bundle.

6. A heat exchanger according to claim 4 in which the ends of the innermost arc of each tube bundle are located at the mid-point between tubes of such arc and of the adjacent arcs.

7. A heat exchanger according to claim 1 wherein for each tube bundle, the radius of curvature of the innermost arc of such bundle is greater than the distance between said inner most arc and said axis of symmetry.

8. A heat exchanger according to claim 1 wherein for at least some of said tube bundles, the ends of said arcs in each such tube bundle are defined by radial lines drawn from the center of curvature of the arcs of such tube bundle.

* * * * *